US007270101B2

(12) United States Patent
Letourneau

(10) Patent No.: US 7,270,101 B2
(45) Date of Patent: Sep. 18, 2007

(54) INTAKE MANIFOLD SHAFT AND BLADE ATTACHMENT

(75) Inventor: Mark Letourneau, Dover Centre (CA)

(73) Assignee: MAHLE Technology, Inc., Farmington Hills, MI (US)

( * ) Notice: Subject to any disclaimer, the term of this patent is extended or adjusted under 35 U.S.C. 154(b) by 0 days.

(21) Appl. No.: 11/186,010

(22) Filed: Jul. 20, 2005

(65) Prior Publication Data

US 2007/0017470 A1 Jan. 25, 2007

(51) Int. Cl.
*F02M 35/10* (2006.01)
*F02M 35/104* (2006.01)

(52) U.S. Cl. ..... 123/184.38; 251/305

(58) Field of Classification Search ..... 123/184.38, 123/336, 337, 583; 251/308, 305
See application file for complete search history.

(56) References Cited

U.S. PATENT DOCUMENTS 1,857,466 A * 5/1932 Mallory ..... 123/336
3,143,132 A * 8/1964 Pangburn ..... 137/375
4,111,395 A * 9/1978 Sheppard ..... 251/306
4,213,595 A * 7/1980 Sheppard ..... 251/308
4,399,833 A * 8/1983 Holtgraver ..... 137/315.22
5,040,508 A * 8/1991 Watanabe ..... 123/396
5,992,378 A * 11/1999 Parkinson ..... 123/337
6,543,413 B2 * 4/2003 Lozen et al. ..... 123/337
2002/0104981 A1 * 8/2002 Gnage et al. ..... 251/305
2005/0000488 A1 * 1/2005 Shibata et al. ..... 123/337

* cited by examiner

*Primary Examiner*—Stephen K. Cronin
*Assistant Examiner*—Ka Chun Leung
(74) *Attorney, Agent, or Firm*—Carlson, Gaskey & Olds

(57) ABSTRACT

An arrangement for attaching a blade to a shaft for use in intake manifolds, uses fasteners that create a load on the blade. Fasteners are inserted through fastener holes in the blade and through shaft holes in the shaft. Once inserted outward pressure by the fastener on the shaft and the blade places the assembly under a constant load. The load prevents the shaft and the blade from vibrating against each other during engine operation. The same attachment method can also be used to retain and bias a shaft locater to the shaft.

15 Claims, 4 Drawing Sheets

INTAKE MANIFOLD SHAFT AND BLADE ATTACHMENT

BACKGROUND OF THE INVENTION

This invention relates generally to an arrangement for attaching a blade to a shaft for use in intake manifold assembly, which reduces noise and vibrations between the shaft and blade.

Intake manifolds control the amount of air entering internal combustion engines. Air enters the intake manifold and flows through to the engine. Intake manifolds use shaft and blade assemblies to control the intake of air into the manifold assembly.

The shafts have commonly been manufactured from plastic and coated with rubber to lower vibration and noise. However, plastic shafts have low durability and strength. The blades are also manufactured from plastic. Prior art blades are molded from plastic and have circular portions designed so the blade can slide onto the shaft.

During manufacture imperfections occur in the shaft, other assembly components, and the manifold housing due to manufacturing tolerances. Manufacturing variations in the shaft and the blades create clearance problems when the blades and the shaft are assembled. The imperfections may be minimal while at rest. However, during operation an imperfect fit between the blades and shaft may cause the blades and shaft to vibrate, creating chatter noise.

An arrangement for attaching intake manifold shafts and blades to reduce vibration noise during engine operation is needed.

SUMMARY OF THE INVENTION

The invention is an arrangement for attaching a blade to a shaft for use in intake manifolds. An intake manifold shaft sub-assembly has a shaft with at least one blade attached to the shaft by using fasteners that create a load on the blade. The load prevents the shaft and the blade from vibrating against each other during engine operation.

The fasteners are preferably spring pins. However, any fastener may be used which will apply a load to the shaft and blade once assembled. The blade has a shaft interface formed to at least partially surround the shaft. However, due to manufacturing variances the shape of the shaft interface may not exactly match the contour of the shaft.

The fasteners are inserted through fastener holes in the blade and through the shaft holes in the shaft. Once inserted the fasteners expands slightly to create a press fit. The outward pressure by the fastener on the shaft and the blade places the assembly under a constant load. The load prevents vibration between the shaft and blade, even when clearances exist.

The same attachment method can also be used to retain and bias a shaft locater to the shaft. Once the shaft assembly is assembled within the intake manifold housing, a housing wall prevents the fasteners from leaving the fastener holes and falling in the engine.

These and other features of the present invention can be best understood from the following specification and drawings, the following of which is a brief description.

DETAILED DESCRIPTION OF THE PREFERRED EMBODIMENT

Figure 1:
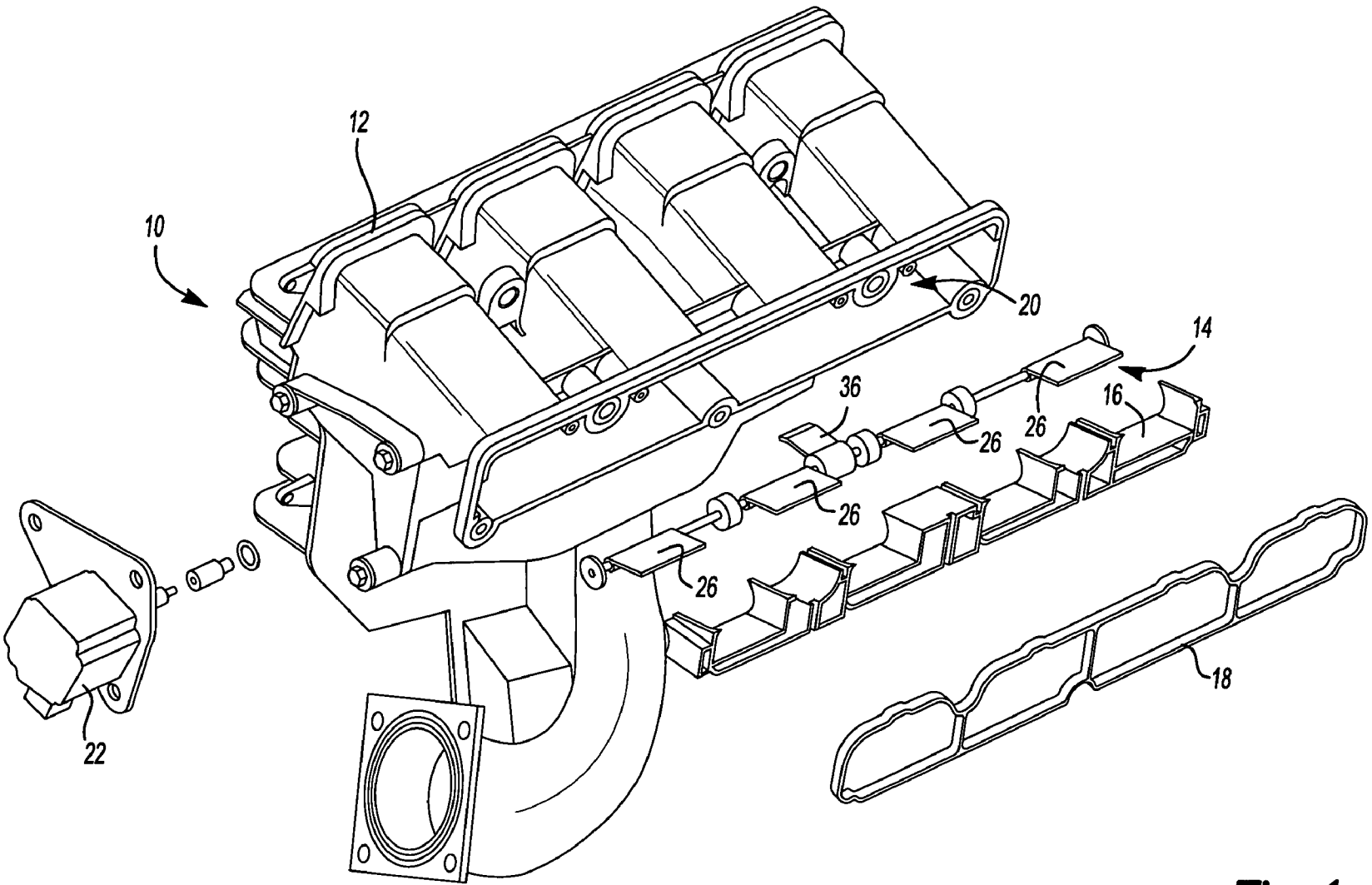
FIG. 1 shows an exploded view of an intake manifold and intake shaft and blade assembly.

FIG. 1 shows an intake manifold assembly 10. The intake manifold assembly 10 includes a housing 12, a shaft assembly 14, an intake insert 16, and a flange seal 18. The shaft assembly 14 is assembled into opening 20 within the housing 12. The intake insert 16 is placed within the opening 20 to retain and support the shaft assembly 14. The flange seal 18 is assembled last. The flange seal 18 seals around the opening 20 once the intake manifold assembly 10 is mounted to the engine. Bolts or other fasteners may be used to retain the shaft assembly 14 within the housing 12 until the intake manifold assembly 10 can be mounted to the engine. Once mounted to the engine the shaft assembly 14 is held in place by the engine. An actuator 22 is mounted on the housing 12. Following assembly, actuator 22 is connected to the shaft assembly 14. During operation of the engine the actuator 22 controls airflow through the main passage of the intake manifold assembly 10 by rotating the shaft assembly 14, as known.

Figure 2A:
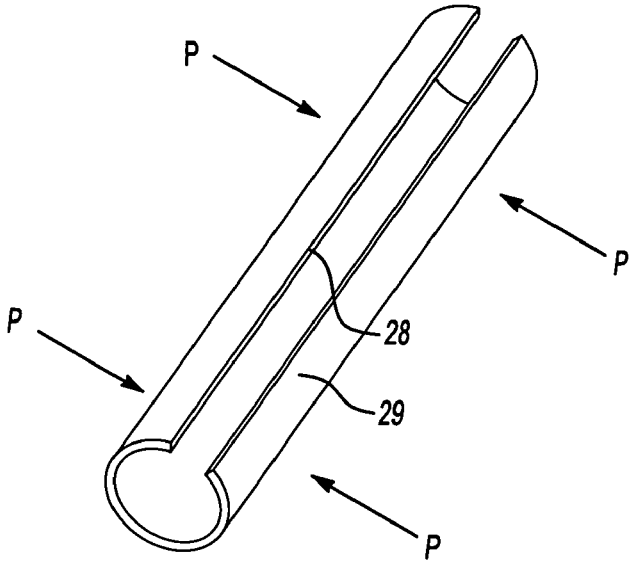
FIG. 2A is perspective of the fastener as pressure is applied for assembly.
Figure 2B:
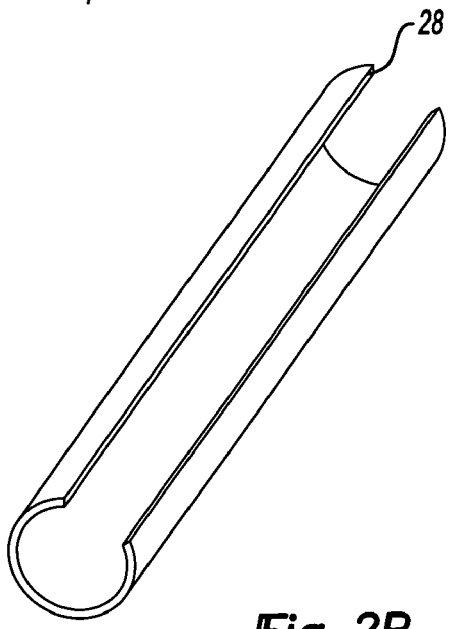
FIG. 2B is perspective of the fastener with no pressure applied.
Figure 3:
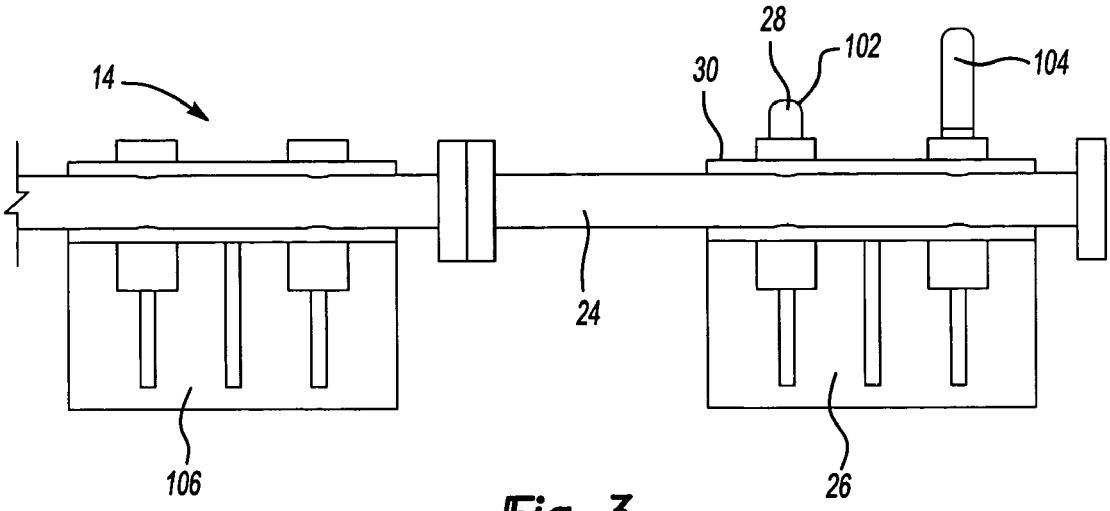
FIG. 3 is a perspective view of an intake shaft and blade assembly.

The shaft assembly 14 has a shaft 24 with at least one blade 26 attached to the shaft 24. The shaft 24 and blade 26 may be manufactured from metal, preferably aluminum. As shown in FIG. 3, the blade 26 is attached using fasteners 28. Fastener 102 is shown fully inserted within the shaft 24 and the blade 26. Fastener 104 is shown partially inserted within the shaft 24 and the blade 26. The blade 106 is shown positioned on the shaft 24 prior to insertion of the fasteners 28. In the embodiment shown, the fasteners are spring pins. A spring pin fastener 28 has a c-shaped cross-section, shown in FIG. 2A. As represented by arrows P, pressure is applied to an outer surface 29 of the fastener 28 during assembly into the blade 26 and shaft 24. Pressure may be applied with pliers, by hand, or other appropriate methods. Once the fastener 28 is inserted, pressure to the outer surface 29 is removed and the fastener 28 expands in circumference, FIG. 2B. The expanded circumference of the fastener 28 places a small load on the shaft 24 and the blade 26. The load prevents the shaft 24 and the blade 26 from vibrating against each other during engine operation. Although spring pins are shown, any fastener 28 may be used which will apply a load to the shaft 24 and blade 26 once assembled.

Referring to FIG. 3, the blade 26 has a shaft interface 30 formed to at least partially surround the shaft 24. The shape of the shaft interface 30 corresponds to the shape of the shaft 24. Due to manufacturing variances the shaft interface 30 often does not exactly match the contour of the shaft 24.

Figure 4:
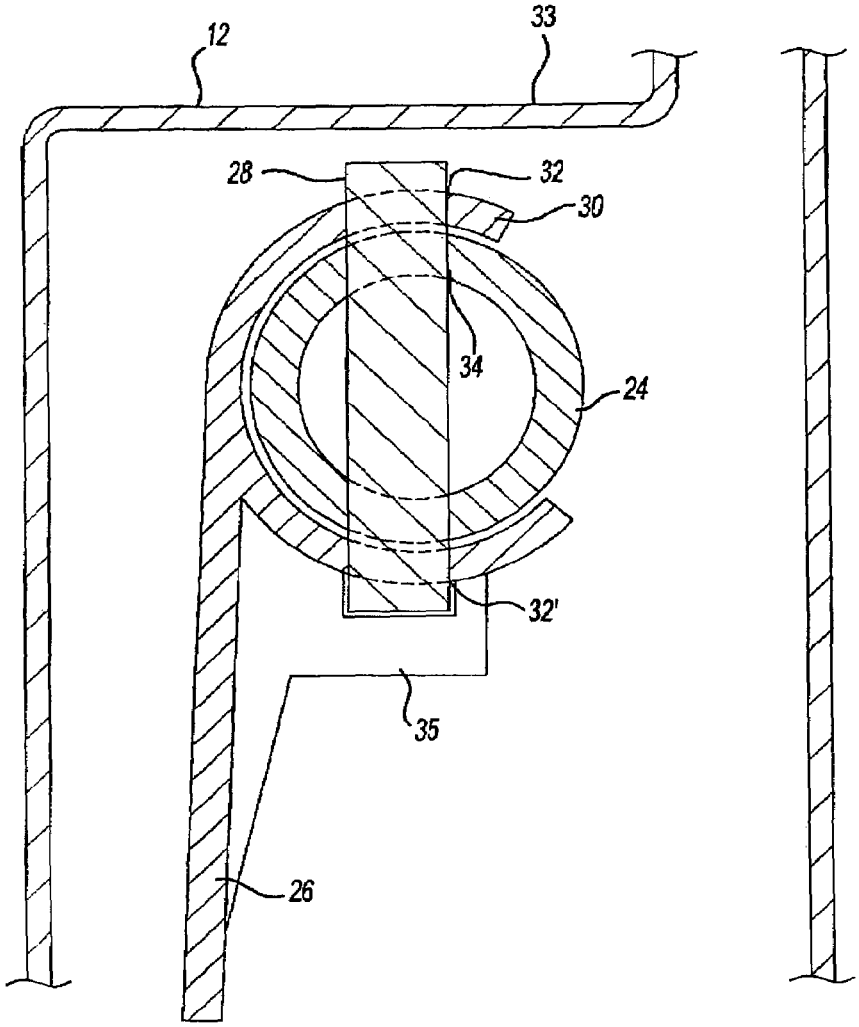
FIG. 4 is a cross-section of the shaft and the blade assembled in the housing.

FIG. 4 shows a cross-section of the shaft 24 and the blade 26 assembled in the housing 12. Fastener holes 32 and 32' are drilled into the blade 26 during manufacture. The fastener holes 32 and 32' in the blade 26 correspond with shaft holes 34 once assembled. Fastener 28 is inserted through the fastener holes 32 and 32' in the blade 26 and through the shaft holes 34 in the shaft 24. Once inserted pressure used to assemble the fastener 28 is removed. The fastener 28 expands slightly to create a press fit. The outward pressure by the fastener 28 on the shaft 24 and the blade 26 places the shaft assembly 14 under a load. The load prevents vibration between the shaft 24 and blade 26. The pressure applied by the fastener 28 is enough to create a constant load however, is small enough to not stress the shaft 24 and blade 26.

The fastener holes 32 and 32' in the blade 26 are formed to prevent the fastener 28 from being able to enter the cylinder head once the shaft assembly 14 has been installed within the intake manifold housing 12. The fastener hole 32 extends completely through the shaft interface 30 while the fastener hole 32' does not extend all the way through the shaft interface 30. That is, portion 35 of the shaft interface 30 prevents the fasteners 28 from passing through the fastener hole 32'. Once the shaft assembly 14 is assembled within the housing 12 the walls 33 of the housing 12 prevent the fastener 28 from exiting back through the fastener holes 32 and 32'. Thus, the fasteners 28 cannot become loose within the engine or intake manifold assembly 10.

Figure 5:
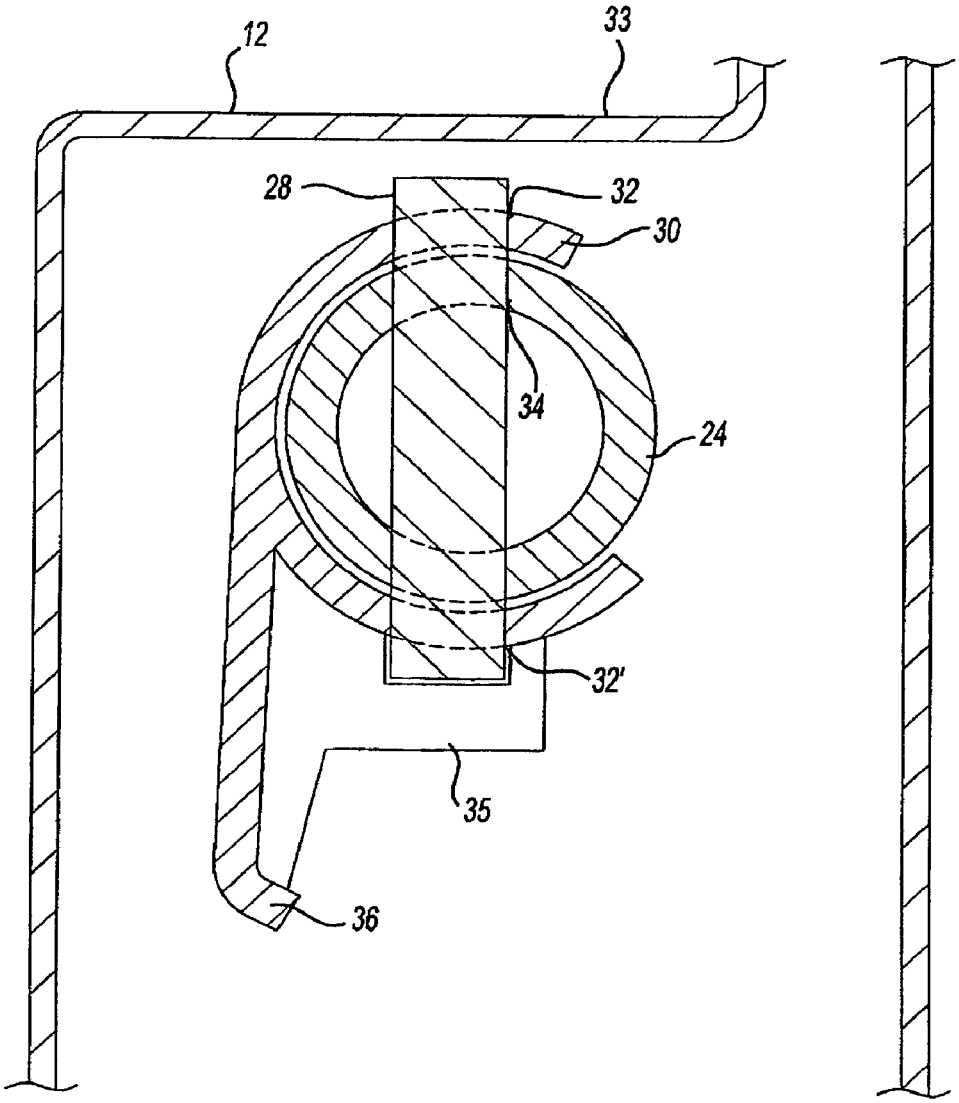
FIG. 5 is a cross-section of the shaft and the shaft locator assembled in the housing.

In addition, although the above embodiment showed fasteners 28 which create a bias between a blade 26 and a shaft 24 the fasteners 28 can also be used to retain and bias a shaft locater 36, as shown in FIG. 5. Each shaft locator 36 is assembled to the shaft 24 by fasteners 28, which operate to attach the shaft locator 36 to the shaft 24 in a manner similar to the attachment of the blade 26 to the shaft 24 as described above. The shaft locator 36 assists in controlling airflow through the intake manifold assembly 10. The shaft locator 36 provides feedback on the rotational position of the shaft 24 to control the position of the blade 26 within the intake manifold assembly 10.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An intake manifold shaft assembly comprising:

a shaft including a shaft through hole; and a blade secured to the shaft with at least one blade fastener, the at least one blade fastener creating a load on the blade, wherein the blade includes a shaft interface formed to at least partially surround the shaft and the shaft interface includes a shaft interface hole that corresponds to the shaft through hole for receiving the at least one blade fastener, wherein the shaft interface hole does not extend completely through the shaft interface.

2. The intake manifold shaft assembly of claim 1, wherein the at least one blade fastener is a spring pin.

3. The intake manifold shaft assembly of claim 2, wherein there are at least two of the spring pins to secure the blade to the shaft.

4. The intake manifold shaft assembly of claim 1, wherein a locater is secured to the shaft with at least one locater fastener, the at least one locater fastener creating a load on the locater.

5. The intake manifold shaft assembly of claim 4, wherein the locater fastener is a spring pin.

6. The intake manifold shaft assembly of claim 1, wherein the shaft is metal.

7. The intake manifold shaft assembly of claim 1, wherein the blade is metal.

8. An intake manifold assembly comprising:

a housing;

a shaft including a shaft through hole secured within the housing; and a blade secured to the shaft with at least one blade fastener, the at least one blade fastener creating a load on the blade, wherein the blade includes a shaft interface formed to at least partially surround the shaft and the shaft interface includes a shaft interface hole that corresponds to the shaft through hole for receiving the at least one blade fastener, wherein the shaft interface hole does not extend completely through the shaft interface.

9. The intake manifold assembly of claim 8, wherein a locater is secured to the shaft with at least one locater fastener, the at least one locater fastener creating a load on the locater.

10. The intake manifold assembly of claim 9, wherein the locater fastener is held in place by a wall of the housing.

11. The intake manifold assembly of claim 8, wherein said at least one blade fastener is a spring pin.

12. The intake manifold assembly of claim 11, wherein there are at least two of the spring pins securing the blade to the shaft.

13. The intake manifold assembly of claim 8, wherein the shaft is metal.

14. The intake manifold assembly of claim 8, wherein the blade is metal.

15. The intake manifold assembly of claim 8, wherein the blade fastener is held in place by a wall of the housing.

* * * * *